United States Patent [19]

Kling

[11] Patent Number: 4,566,606

[45] Date of Patent: Jan. 28, 1986

[54] DISPENSER FOR CONTAINING AND DISPENSING A PREMOISTENED WEB OF MATERIAL

[76] Inventor: Thord Kling, Svampstigen 8 E, S-671 00 Arvika, Sweden

[21] Appl. No.: 499,764

[22] PCT Filed: Sep. 15, 1981

[86] PCT No.: PCT/SE81/00262

§ 371 Date: May 11, 1983

§ 102(e) Date: May 11, 1983

[87] PCT Pub. No.: WO83/01054

PCT Pub. Date: Mar. 31, 1983

[51] Int. Cl.[4] ..... G07F 11/66

[52] U.S. Cl. ..... 221/25; 221/135; 206/210; 206/225; 206/409

[58] Field of Search ..... 221/61, 63, 25, 135; 206/409, 210, 225; 225/106; 242/55.2, 55.53; 118/43

[56] References Cited

U.S. PATENT DOCUMENTS

| | | | |
|---|---|---|---|
| 843,579 | 2/1907 | Burr et al. | 225/106 |
| 2,684,716 | 7/1954 | Mills et al. | 206/409 |
| 2,737,353 | 3/1956 | Banks, Jr. . | |
| 3,127,054 | 3/1964 | Meyers | 221/25 |
| 3,129,812 | 4/1964 | Deasy . | |
| 3,368,522 | 2/1968 | Cordis . | |
| 3,527,343 | 9/1970 | Rutter . | |
| 3,592,161 | 7/1971 | Hoffmann | 118/43 |
| 3,982,659 | 9/1976 | Ross | 221/63 |
| 3,986,479 | 10/1976 | Bonk | 225/106 |
| 3,995,582 | 12/1976 | Douglas | 206/409 |
| 4,101,026 | 7/1978 | Bonk . | |
| 4,239,164 | 12/1980 | Barnsbee et al. . | |
| 4,428,497 | 1/1984 | Julius et al. | 206/210 |

FOREIGN PATENT DOCUMENTS

| | | |
|---|---|---|
| 1277074 | 9/1968 | Fed. Rep. of Germany . |
| 2031070 | 12/1971 | Fed. Rep. of Germany . |
| 2204402 | 8/1973 | Fed. Rep. of Germany . |
| 3005769 | 5/1982 | Fed. Rep. of Germany . |
| 57354 | 12/1936 | Norway . |
| 418951 | 7/1981 | Sweden . |

*Primary Examiner*—Joseph J. Rolla
*Assistant Examiner*—Andrew Jones
*Attorney, Agent, or Firm*—Sheridan Neimark; Karl W. Flocks

[57] ABSTRACT

A dispenser for containing and dispensing a premoistened web of material (26) comprises a magazine (2) for containing the web of material and a dispensing portion (3) associated with the magazine and having an opening (20) for dispensing the web of material. A passage (23) extends between the magazine (2) and the dispensing opening (20) and is adapted to take up the web of material such that the latter forms a seal in the passage, which prevents drying of the web of material.

7 Claims, 3 Drawing Figures

DISPENSER FOR CONTAINING AND DISPENSING A PREMOISTENED WEB OF MATERIAL

This invention relates to a dispenser for containing and dispensing a premoistened web of material, comprising a magazine for containing the web of material and a dispensing portion associated with the magazine and having an opening for dispensing the web of material. More particularly, the invention relates to dispensers for injection tissues for medical use.

Dispensers of the above-mentioned type have been known for a long time in a great many different embodiments. Most of the prior art dispensers consist of a two-part can the lower part of which forms a magazine for a premoistened strip while the upper part thereof has a dispensing opening for a strip. The dispensing opening may be in the form of a straight slot, several crossing slots or some other type of opening. To prevent drying of the strip the dispensing opening can be closed by means of a cover. If one forgets to close the cover after a strip piece has been removed, the strip in the can will rapidly dry up. This is a great disadvantage of the prior art dispensers. A further disadvantage is the difficulty which disabled persons experience in opening the cover.

One object of the present invention is to provide a dispenser of the afore-mentioned type, in which one need not close the dispensing opening between removals of strip pieces, in order to retain the moisture in the strip.

Another object of the invention is to provide a dispenser in which the procedure of dispensing the strip is controlled in such a manner that only one strip piece is obtained at each removal.

These objects are realized by means of a dispenser the individual features of which will become apparent from the characterising clauses of the appended claims.

The invention will be described in more detail with the aid of an embodiment with reference to the acompanying drawing in which.

Figure 1:
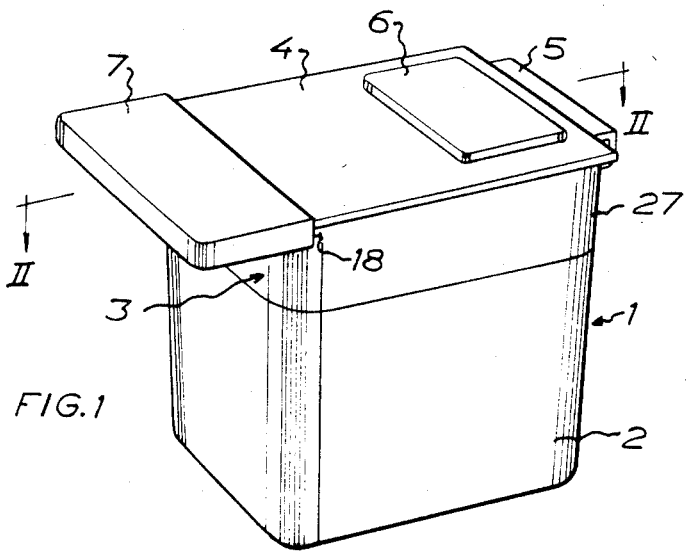
FIG. 1 shows a perspective view of a dispenser according to the present invention.
Figure 2:
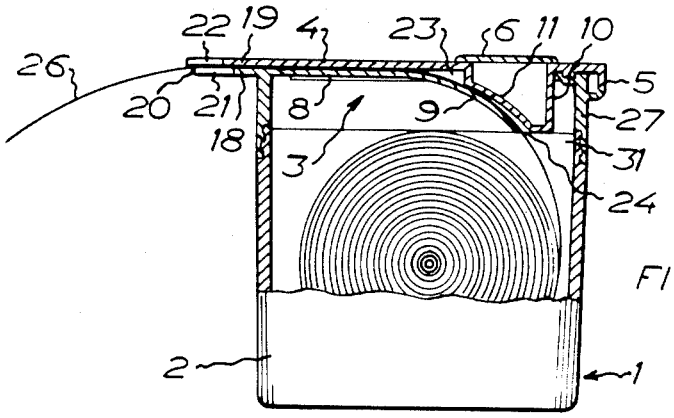
FIG. 2 is a section on line II—II in FIG. 1 with a sealing device removed and a strip contained therein partially dispensed.

The dispenser 1 according to the present invention, which is illustrated in FIG. 1, comprises a box-shaped magazine 2 and a dispensing portion 3 detachably mounted on the magazine. The dispensing portion consists of a box-shaped member 27 with an open bottom and an upper side 29 (FIG. 3), said bottom being connected to the magazine 2 by means of a spring catch, bayonet clutch or other suitable tight coupling. An inspection and service cover 4 engages the upper side 29 and is connected to the box-shaped member 27 via hinge means 5. The dispensing portion further has a sealing device 7 for closing a dispensing opening 20 (FIG. 2). The cover 4 has a raised section 6 to accommodate directions for use. The magazine 2 is of impact-resistant polystyrene and the dispensing portion 3 of LD-polyethylene.

The sealing device 7 serves two functions. Firstly, it fixedly retains a protruding part 19 of the service cover 4 to a protruding part 18 of the upper side 29 of the box-shaped member 27 and thus serves as a transport safety device. Secondly, it closes the dispensing opening 20 of the dispenser 1 and contributes to reducing the risk that a strip 26 (FIG. 2) will dry up, especially if the dispenser should not be used for a long period of time.

The strip is about 15 m in length and 45 mm in width. It is perforated so that 300 tissues in the format 45×50 mm are obtained. The strip consists of non-woven and tissue and is impregnated with a 70% ethyl-alcohol and contains 0.5% chlorohexidine.

Figure 3:
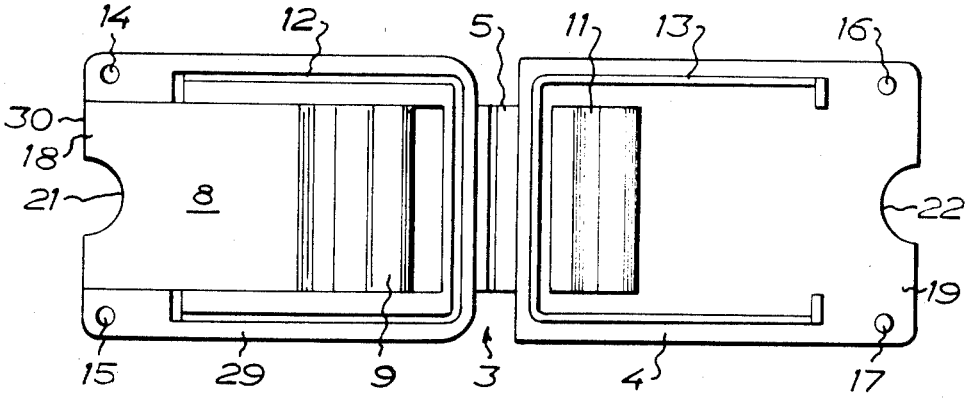
FIG. 3 shows a top plan view of a dispensing portion with a service and inspection cover in opened position.

FIGS. 2 and 3 show a dispensing passage 23 in the dispensing portion 3, said passage extending between the dispensing opening 20 and the upper part of the magazine. The passage is formed between the cover 4 and the tongue 8 which constitutes a countersunk portion of the upper side 29 of the box-shaped member 27. A sealing groove 12 which cooperates with a mating sealing strip at the cover 4, extends around the major portion of the passage on the upper side of the box-shaped member. Two locking holes 14, 15 which cooperate with mating locking pins 16, 17 on the cover to prevent unintentional opening thereof, are provided in the upper side in front of the sealing groove 12.

The end 9 of the tongue 8 which opens into the upper part of the magazine 2 is curved downwardly from the countersunk portion and terminates at a distance from the box-shaped member 27 to form a magazine outlet 31. The tongue 8 forms a guide path for the strip 26 without any sharp edges, whereby the risk that the strip will unintentionally be torn off between the magazine and the outlet opening 20 is reduced. The cover 4 has a shoulder 10 which protrudes into the magazine outlet 31 opposite the curved end 9 of the tongue. The shoulder has a curved surface 11 which is so designd that it forms, together with the curved end 9, a conical inlet 24 to the passage 23.

The height of the passage inside the conical inlet is slightly less than the thickness of the strip, and the width of the tongue 8 corresponds to that of the strip. As a result, the strip itself forms a seal in the dispensing portion 3, which prevents drying of the strip both in the magazine 2 and in the dispensing portion 3. The sealing groove 12 on the upper side 29 and the sealing strip 13 at the cover 4 also assist in preventing evaporation of the ethyl alcohol through the interface between the upper side 29 and the cover 4.

The front portion of the tongue 8 at the dispensing opening 20 is provided with a halfmoon-shaped thumbhold cutout 21, and the protruding portion 19 of the cover 4 has a corresponding thumbhold cutout 22. Each of the above-mentioned perforations in the strip comprises two straight perforation lines which extend at right angles inwardly towards the middle of the strip from the two longitudinal edges thereof, and a half-moon-shaped perforation line interconnecting said two lines. The halfmoon-shaped perforation line is convex, while the thumbhold cutouts 21, 22 are concave as viewed from the dispensing opening 20. By reason of the clamping of the strip between the tongue 8 and the cover 4, whereby the perforations are relieved of load, and the fibrous structure of the strip, said strip can be withdrawn from the dispensing opening 20 without any risk that an injection tissue is torn off inside the dispensing portion 3. However, as soon as the straight perforation lines come to lie flush with the terminal edge 30 of the tongue 8, the withdrawn injection tissue will be torn off from the strip. Owing to the perforation line on the strip which is "reversed" in relation to the thumbhold cutouts 21, 22, there will be formed on the strip 26 a gripping portion in the form of a circular disc for withdrawal of the next injection tissue. The strip is preferably drawn obliquely upwards or obliquely downwards, using the cover or the upper side 29 as a tearing edge.

FIG. 2 shows that the cover 4 protrudes a slightly longer distance than the upper side 29 at the dispensing opening 20, which facilitates, on the one hand, the raising of the cover and, on the other hand, the upward tearing off of the strip.

Should the strip happen to tear inside the dispensing portion 3, one can open the cover 4 and pull forth the strip to the dispensing opening 20 and then close the cover again.

The dispenser 1 is loaded in that the dispensing portion is removed from the magazine 2 and a strip is placed therein. The cover 4 is opened and the end of the strip is introduced into the magazine outlet 31 and placed against the tongue 8. After that, the dispensing portion is mounted on the magazine, the strip is adjusted on the tongue and the cover is closed.

I claim:

1. A dispenser for containing and dispensing a premoistened web of material (26), comprising a container (2) for containing the web of material and a dispensing portion (3) associated with the container and having an opening (20) for dispensing the web of material, wherein a passage (23) having boundary walls (4, 8) extends between the container (2) and the dispensing opening (20) and is adapted to take up the web of material such that the web of material in the passage (23) constitutes a seal in the passage which prevents drying of said web (26) and wherein the weight of the passage (23) is slightly less than the thickness of the web of material (26), whereby the sealing power of said web in said passage is ensured and friction is brought about between said web and the boundary walls (4, 8) of the passage, said friction facilitating tearing off said web at the dispensing opening (20), said dispensing portion (3) including an inner cover which has a frame member (27) sealingly applicable to the container and a plate (29) which is formed integrally with said frame member and which has a countersunk portion (8) extending in a longitudinal direction of said plate, an opening to the interior of the container which is disposed in said portion (8), and a tongue (9) associated with said countersunk portion and extending downward from said countersunk portion into the interior of the container adjacent said opening, and an outer cover (4) which by hinge means (5) is pivotally connected to the inner cover and which has an inner surface on its side facing the inner cover, said inner surface having a shoulder (10) which, when said two covers are interconnected, is adapted to project into said opening to form, together with said tongue, an inlet opening for the web material (26) into the passage (23) defined between said countersunk portion and the inner side of the outer cover.

2. A dispenser as claimed in claim 1, wherein the tongue (9) and the outer cover (4) form a conical inlet (24) to the passage (23).

3. A dispenser as claimed in claim 2, wherein the tongue (9) is curved and the shoulder (10) has a complementary curved surface (11).

4. A dispenser as claimed in claim 1, wherein the dispensing portion (3) has a sealing groove (12) which extends outside the passage (23), and a corresponding sealing strip (13) at the outer cover (4).

5. A dispenser as claimed in claim 1, wherein the dispensing portion (3) has at least one locking hole (14, 15) and at least one mating locking pin (16, 17) at the outer cover (4).

6. A dispenser as claimed in claim 1, wherein the dispensing portion (3) is detachably mounted on the container (2).

7. A dispenser as claimed in claim 1 further comprising a sealing device (7) which is adapted to be placed over the dispensing over (20) to seal said dispensing opening and to prevent unintentional raising of the outer cover (4).

* * * * *